US012716631B2

(12) United States Patent
Brand

(10) Patent No.: US 12,716,631 B2
(45) Date of Patent: Aug. 25, 2026

(54) MOUNTING ASSEMBLY AND MOUNTING BRACKET FOR REFRIGERANT SENSOR

(71) Applicant: Mitsubishi Electric US, Inc., Cypress, CA (US)

(72) Inventor: Shay Brand, Cypress, CA (US)

(73) Assignee: Mitsubishi Electric US, Inc., Cypress, CA (US)

( * ) Notice: Subject to any disclaimer, the term of this patent is extended or adjusted under 35 U.S.C. 154(b) by 117 days.

(21) Appl. No.: 18/821,353

(22) Filed: Aug. 30, 2024

(65) Prior Publication Data

US 2026/0063344 A1 Mar. 5, 2026

(51) Int. Cl.
*F25B 49/00* (2006.01)

(52) U.S. Cl.
CPC ..... *F25B 49/005* (2013.01)

(58) Field of Classification Search
CPC ... F25B 49/005; F25B 2500/222; F24F 11/36; F24F 11/89
See application file for complete search history.

(56) References Cited

U.S. PATENT DOCUMENTS

| | | | | |
|---|---|---|---|---|
| 10,634,404 | B2 | 4/2020 | Obara et al. | |
| 2023/0417435 | A1 | 12/2023 | Epperson et al. | |
| 2024/0295339 | A1* | 9/2024 | Garrett | F24F 11/36 |
| 2025/0369637 | A1* | 12/2025 | Nguyen | F24F 11/36 |

FOREIGN PATENT DOCUMENTS

| | | | |
|---|---|---|---|
| AU | 2019432579 | B2 | 12/2022 |
| JP | 2008051359 | A | 3/2008 |
| JP | 6758435 | B2 | 9/2020 |

* cited by examiner

*Primary Examiner* — Marc E Norman
(74) *Attorney, Agent, or Firm* — Posz Law Group, PLC

(57) ABSTRACT

A mounting assembly for a refrigerant sensor is provided. The mounting assembly includes: a bracket configured to contain a refrigerant sensor; a fastener formed contiguously with the bracket and configured to attach the bracket to a portion of a heating and cooling device without additional hardware; and a fastening hold attached to the fastener and configured to allow a user to manually assist with fastening and unfastening the fastener. The bracket is formed as one contiguous piece that is configured to secure the refrigerant sensor to the bracket without additional hardware.

16 Claims, 5 Drawing Sheets

MOUNTING ASSEMBLY AND MOUNTING BRACKET FOR REFRIGERANT SENSOR

TECHNICAL FIELD

The disclosed systems and methods relate generally to a heating and cooling device (e.g., an air conditioner) including a sensor circuit for detecting refrigerant in the heating and cooling device. Specifically, the sensor circuit is attached to a part of the heating and cooling device such that it requires a minimum of extra hardware to connect it to the heating and cooling device. A bracket is provided that can be secured to the heating and cooling device without the use of additional hardware, and the bracket can accept and secure the sensor circuit without the use of additional hardware.

BACKGROUND

A heating and cooling device (e.g., an air conditioner) will generally include a heat exchanger, which may include coils through which a refrigerant flows, e.g., an A-coil. One common type of refrigerant used by such heating and cooling devices is an A2L refrigerant. The designation A2L indicates that the refrigerant is non-toxic (A), is flammable (2), and has a low burning velocity (L). Other refrigerants may also be used, with varying parameters.

In the heating and cooling device, the refrigerant is cooled in a cooling operation and heated in a heating operation, and air is passed over the coils. This causes the air to exchange heat with the refrigerant passing through the coils and be either heated or cooled depending upon the type or operation being performed.

During heating and cooling operations, a coil-based heat exchanger can leak refrigerant into the air surrounding the heat exchanger. This often happens where pipes are brazed, though other types of leaks are also possible.

Leaks in a heat exchanger coil are undesirable for several possible reasons. First, if the refrigerant used in heating and cooling devices is toxic, leaked refrigerant may cause a health hazard to people in the building containing the heating and cooling device. Leaked refrigerant from the heating and cooling device can be blown into the area being heated or cooled and may be breathed by those inside that the building containing the heating and cooling device. Second, if the refrigerant is flammable, leaked refrigerant can increase the fire risk in the building containing the heating and cooling device. Third, since the proper operation of a coil-based heat exchanger requires sufficient refrigerant pass through the coils, a leakage of refrigerant can cause the heating and cooling device to function less efficiently. Fourth, leaked refrigerant must be replaced, meaning that a refrigerant leak will result in additional costs for operating the heating and cooling device.

As a result, many heating and cooling devices contain one or more refrigerant sensors to detect refrigerant leaks so that they can be identified and corrected quickly, and so avoid or minimize the problems identified above.

Furthermore, some regulations require that the refrigerant sensors in a heating and cooling device be able to detect refrigerant leaks within a certain length of time. To meet these requirements, it is generally desirable to locate the refrigerant sensors as close where leaks are most likely to occur in the heating and cooling device. As a result, in some embodiments, the refrigerant sensor will be located proximate to a drip pan placed beneath a heat exchanger coil, which is close to where leaks are likely to occur. In these embodiments, a mechanism can be provided to secure a refrigerant sensor to a drain pan.

It is desirable to make such attachment mechanisms as simple as possible and require as few additional elements as possible. It is therefore desirable to provide an attachment mechanism for a refrigerant sensor that can be secured to a drain pan without the need for additional hardware to either secure the attachment mechanism to the drain pan or to secure the refrigerant sensor to the attachment mechanism.

SUMMARY OF THE INVENTION

According to one or more embodiments, a mounting assembly for a refrigerant sensor, is provided, comprising: a bracket configured to contain a refrigerant sensor; a fastener formed contiguously with the bracket and configured to attach the bracket to a portion of a heating and cooling device without additional hardware; and a fastening hold attached to the fastener and configured to allow a user to manually assist with fastening and unfastening the fastener, wherein the bracket is formed as one contiguous piece that is configured to secure the refrigerant sensor to the bracket without additional hardware.

The bracket may be formed as a single piece of metal or plastic, or the bracket may be formed from multiple pieces of metal or plastic secured together as a single structure.

The fastener may include a first bent arm; and a second bent arm, the first and second bent arms being configured to grip the portion of the heating and cooling device.

The fastening hold may be a protrusion extending from the first bent arm configured to allow a user to push the clip open.

The fastener may be configured to selectively affix to a drain pan in the heating and cooling device A mounting bracket for a refrigerant sensor may be provided, comprising: a back panel; a first side panel attached to a first side of the back panel and having a first cut-out portion; a second side panel attached to a second side of the back panel and having a second cut-out portion; a fastening bracket formed adjacent to the back panel, the first side panel, and the second side panel; and a fastening hold attached to the fastening bracket and configured to allow a user to manually assist with fastening and unfastening the fastening bracket, wherein the first cut-out portion faces a top of the mounting bracket, the second cut-out portion faces the top of the mounting bracket, the first cut-out portion includes a first narrow point partway along its length such that a first part of the first cut-out portion closer to the top of the mounting bracket as compared to the first narrow point and a second part of the first cut-out portion farther from the top of the mounting bracket from the first narrow point both are wider than a width of the first narrow point, and the fastening bracket is configured to selectively affix to a portion of a heating and cooling device.

The mounting bracket may further comprise a bottom panel formed adjacent to the back panel, the first side panel, and the second side panel, the bottom panel being attached to the fastening bracket.

The fastening bracket may be a clip configured to selectively affix to the portion of the heating and cooling device.

The fastening bracket may include a first bent arm; and a second bent arm, the first and second bent arms being configured to grip the portion of the heating and cooling device.

The fastening hold may be a protrusion extending from the first bent arm configured to allow a user to push the clip open.

The mounting bracket may further comprise a bottom panel formed adjacent to the back panel, the first side panel, and the second side panel, the bottom panel being attached to the fastening bracket. The fastening bracket may include a first bent arm extending from a first side of the bottom panel; and a second bent arm extending from a second side of the bottom panel opposite the first panel, and the first and second bent arms may be configured to grip a portion of a heating and cooling device.

The fastening bracket may be configured to selectively affix to a drain pan in the heating and cooling device The fastening bracket may be a clip configured to selectively affix to a wall of a drain pan in a heating and cooling device.

The first side panel may be made of a material of sufficient elasticity to allow the first narrow point to temporarily widen when pressure is applied to sides of the first cut-out portion.

The second cut-out portion may include a second narrow point partway along its length such that a first part of the second cut-out portion closer to the top of the mounting bracket as compared to the second narrow point and a second part of the second cut-out portion farther from the top of the mounting bracket from the second narrow point both are wider than a width of the second narrow point.

The second side panel may be made of a material of sufficient elasticity to allow the second narrow point to temporarily widen when pressure is applied to sides of the second cut-out portion.

A sensor mounting assembly is provided, comprising: a mounting bracket, including a back panel; a first side panel attached to a first side of the back panel and having a first cut-out portion; a second side panel attached to a second side of the back panel and having a second cut-out portion; a fastening bracket formed adjacent to the back panel, the first side panel, and the second side panel; a fastening hold attached to the fastening bracket and configured to allow a user to manually assist with fastening and unfastening the fastening bracket; and a refrigerant sensor assembly, including a refrigerant sensor circuit configured to detect refrigerant in air proximate to the refrigerant sensor; a first protrusion extending from a first side of the refrigerant sensor circuit; and a second protrusion extending from a second side of the refrigerant sensor circuit, wherein the first cut-out portion faces a top of the mounting bracket, the second cut-out portion faces the top of the mounting bracket, the first cut-out portion includes a first narrow point partway along its length such that a first part of the first cut-out portion closer to the top of the mounting bracket as compared to the first narrow point and a second part of the first cut-out portion farther from the top of the mounting bracket from the first narrow point both are wider than a width of the first narrow point, the fastening bracket is configured to selectively affix to a portion of a heating and cooling device, the refrigerant sensor assembly is formed inside a cavity formed by the back panel, the first side panel, and the second side panel, the first protrusion extends into the first cut-out portion, the second protrusion extends into the second cut-out portion, and the first narrow point restrains the refrigerant sensor assembly from moving out of the cavity.

The sensor mounting assembly may further comprise a bottom panel formed adjacent to the back panel, the first side panel, and the second side panel, the bottom panel being attached to the fastening bracket, and the back panel, the first side panel, the second side panel, and the bottom panel defining the cavity.

The fastening bracket may be a clip configured to selectively affix to the portion of the heating and cooling device.

The fastening bracket may include a first bent arm; and a second bent arm, the first and second bent arms being configured to grip the portion of the heating and cooling device.

The fastening hold may be a protrusion extending from the first bent arm configured to allow a user to push the clip open.

The sensor mounting assembly may further comprise a bottom panel formed adjacent to the back panel, the first side panel, and the second side panel, the bottom panel being attached to the fastening bracket, wherein the fastening hold may include a first bent arm extending from a first side of the bottom panel; and a second bent arm extending from a second side of the bottom panel opposite the first panel, and the first and second bent arms being configured to grip a portion of a heating and cooling device.

The fastening bracket may be configured to selectively affix to a drain pan in the heating and cooling device The fastening bracket may be a clip configured to selectively affix to a wall of a drain pan in a heating and cooling device.

The first side panel may be made of a material of sufficient elasticity to allow the first narrow point to temporarily widen when pressure is applied to sides of the first cut-out portion.

The second cut-out portion may include a second narrow point partway along its length such that a first part of the second cut-out portion closer to the top of the mounting bracket as compared to the second narrow point and a second part of the second cut-out portion farther from the top of the mounting bracket from the second narrow point both are wider than a width of the second narrow point.

The second side panel may be made of a material of sufficient elasticity to allow the second narrow point to temporarily widen when pressure is applied to sides of the second cut-out portion.

BRIEF DESCRIPTION OF THE DRAWINGS

The accompanying figures, where like reference numerals refer to identical or functionally similar elements and which together with the detailed description below are incorporated in and form part of the specification, serve to further illustrate an exemplary embodiment and to explain various principles and advantages in accordance with the present disclosure.

DETAILED DESCRIPTION

The instant disclosure is provided to further explain in an enabling fashion the best modes of performing one or more embodiments of the present invention. The disclosure is further offered to enhance an understanding and appreciation for the inventive principles and advantages thereof, rather than to limit in any manner the invention. The invention is defined solely by the appended claims including any amendments made during the pendency of this application and all equivalents of those claims as issued.

It is further understood that the use of relational terms such as first and second, and the like, if any, are used solely to distinguish one from another entity, item, or action without necessarily requiring or implying any actual such relationship or order between such entities, items or actions. It is noted that some embodiments may include a plurality of processes or steps, which can be performed in any order, unless expressly and necessarily limited to a particular order; i.e., processes or steps that are not so limited may be performed in any order.

Sensor Bracket

Figure 1:
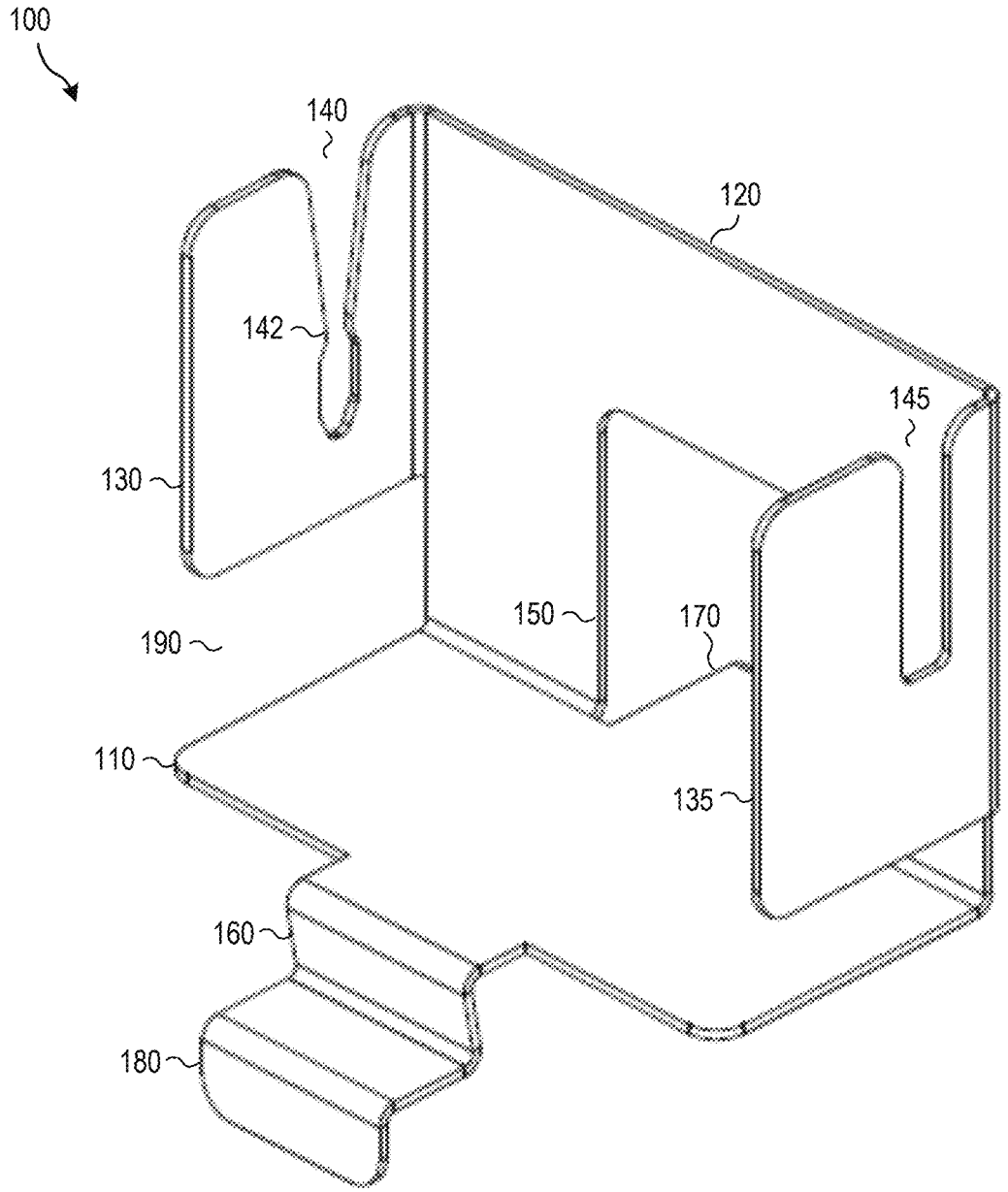
FIG. 1 is a perspective view of a sensor bracket for a refrigerant sensor according to disclosed embodiments.

FIG. 1 is a perspective view of a sensor bracket 100 for a refrigerant sensor according to disclosed embodiments. The sensor bracket 100 is configured to be attached to a side of a drain pan in a heating and cooling device (e.g., an air conditioner) without the need for additional hardware.

As shown in FIG. 1, the sensor bracket 100 includes a bottom panel 110, a back panel 120, a first side panel 130, and a second side panel 135. The first side panel 130 includes a first opening 140 (a first cut-out portion) that has a first narrow point 142. The second side panel 135 has a second opening 145 (a second cut-out portion). The back panel includes a back opening 150. A front fastener 160 is attached to a front side of the bottom panel 110, and a back fastener 170 is attached to a back side of the bottom panel 110. The front fastener 160 includes a fastening hold 180.

The bottom panel 110, the back panel 120, the first side panel 130, and the second side panel 135 together define a sensor area 190 configured to contain a refrigerant sensor (not shown in FIG. 1). In the embodiment shown in FIG. 1, the back panel 120 is attached to the bottom panel 110 and the first and second side panels 130, 135 are attached to the back panel 120 such that they face each other. This embodiment provides an empty space between the first side panel 130 and the bottom panel 110 and between the second side panel 135 and the bottom panel 110. However, this is by way of example only.

Alternate embodiments could vary how these elements are attached to each other. For example, in one embodiment, the back panel 120, the first side panel 130, and the second side panel 135 can all be attached to the bottom panel 110. In another embodiment the first and second side panels 130, 135 can be attached to the bottom panel 110, the back panel 120 can be attached to the first side panel 130 and/or the second side panel 135, and space can be provided between the back panel 120 and the bottom panel 110. Various other configurations of how the different panels 110, 120, 130, 135 are connected can be provided. In some alternate embodiments, a front panel opposite the back panel can be provided to allow for four sides to define the sensor area 190.

The first opening 140 in the first side panel 130 and the second opening 145 in the second side panel 135 are openings facing away from the bottom panel 110. The first and second openings 140, 145 are arranged such that protrusions on opposite sides of the refrigerant sensor can slide into the first and second openings, securing the refrigerant sensor in place.

In addition, the first opening 140 incudes a first narrow point 142 partway along its length. This first narrow point 142 will be narrower than the width of the protrusion from the corresponding side of the refrigerant sensor, such that it will restrict the motion of the protrusion past the first narrow point 142. However, the material that constitutes the first side panel 130 should be made of a material with sufficient flexibility that the first narrow point 142 will widen when sufficient pressure is provided to press the sides apart but will then return to its original position once the pressure is removed.

In this way, the protrusion can be pushed past the first narrow point 142 when the refrigerant sensor is moved into the sensor area 190, but the protrusion will not easily move back out of the first opening 140 without a similar amount of pressure being applied to push the protrusion again past the first narrow point 142. Such pressure will not be likely absent effort by an external party.

This configuration will allow the refrigerant sensor to be inserted into the sensor area 190 and be removed from the sensor area 190 by applying sufficient force to the refrigerant sensor, but will allow that absent such force being applied, the refrigerant sensor will be secured into the sensor area 190 because the protrusion cannot easily move past the first narrow point 142.

In the embodiment of FIG. 1, the first and second openings 140, 145 are shorter than the length of the first and second side panels 130, 135, allowing for some portion of the first and second side panels 130, 135 to remain between the first and second openings 140, 145 and the bottom panel 110. However, this is by way of example only. In alternate embodiments, the first and second openings 140, 145 can extend all the way to the bottom panel 110. In one such embodiment, the first side panel 130 can be formed as two first side panels extending from the bottom panel 110 with the first opening 140 formed between them. Similarly, the second side panel 135 can be formed as two second side panels extending from the bottom panel 110 with the second opening 145 formed between them.

Since a single narrow point should be sufficient to hold the refrigerant sensor in place, only the first opening 140 need have a first narrow point 142. The second opening 145 can have a uniform width. However, this is by way of example only. In alternate embodiments the second opening 145 can have a corresponding second narrow point.

The back opening 150 is provided in this embodiment between the bottom panel 110 and a portion of the back panel 120. This opening is provided such that in an embodiment in which the sensor bracket 100 is made of metal, the back fastener 170 can be formed out of a portion of the metal that defines the back opening 150 by its absence.

The front fastener 160 and the back fastener 170 are configured to together grip the side of a drain pan (not shown in FIG. 1). In the embodiment of FIG. 1, the front fastener 160 is a first bent arm and the back fastener 170 is a second bent arm. These two bent arms are configured to grip the side of the drain pan to secure the sensor bracket 100 in place.

The material that makes up the front fastener 160 and the back fastener 170 should have a flexibility such that one or both of the front and back fasteners 160, 170 can be temporarily deformed if sufficient pressure is applied to them to allow the sensor bracket to be fastened to the drain pan or removed from the drain pan. However, once attached to the drain pan, the front and back fasteners 160, 170 should return to their original position and remain in place, absent further pressure being applied to one or more of the front and back fasteners 160, 170. In this way, the front and back fasteners 160, 170 form a fastening bracket (more specifically, a clip) that allows the sensor bracket 100 to be secured to the drain pan.

By having front and back fasteners 160, 170 that grip a drain pan using inward directed pressure, the sensor bracket 100 can be made more stable as compared to an embodiment in which the sensor bracket 100 is held in place by outward pressure applied to portions of the heating and cooling device on either end of the sensor bracket 100 and the friction between the sensor bracket 100 and those adjacent portions of the heating and cooling device. The disclosed embodiment prevents slipping and twisting that might occur in an embodiment in which the sensor bracket 100 was held in place solely by friction.

The fastening hold 180 is attached to the front of the front fastener 160 to allow a user to provide the necessary pressure to the front fastener 160 to deform one or more of the first and second fasteners 160, 170 to either attach the sensor bracket 100 to the drain pan or detach the sensor backet 100 from the drain pan.

In the embodiment of FIG. 1, the fastening hold 180 is a tab that can be pushed with a finger or a tool to temporarily deform one or both of the front and back fasteners 160, 170 to allow the sensor bracket 100 to be attached to or detached from the drain pan. However, this is by way of example only. Alternate embodiments could use a different kind of mechanism that allows for easy attachment and detachment of the sensor bracket 100 to a drain pan. For example, the fastening hold 180 could be replaced by a loop or other kind of opening into which a finger or a tool could be inserted to allow pressure to be imposed on one or both of the front and back fasteners 160, 170.

Furthermore, although the embodiment of FIG. 1 discloses that the sensor bracket 100 is secured in place by pressure between the front and back fasteners 160, 170, and that one or more of the front and back fasteners 160, 170 can be deformed by pressure applied to the fastening hold 180, this is by way of example only. Alternate embodiments could employ a different mechanism for attaching the sensor bracket 100 to the drain pan that uses no additional hardware. For example, the front and back fasteners 160, 170 could be arranged to be loose enough to fit around a portion of the drain pan without additional pressure being applied to them. The fastening hold 180 could be replaced with a clamp that can selectively draw the front and back fasteners 160, 170 together. In this way, the clamp could be opened to allow the sensor bracket 100 to be attached to or detached from the drain pan, and then closed to secure the sensor bracket 100 to the drain pan. The clamp could be configured to allow a user to easily open or close the clamp with a finger or a tool.

In addition, although the disclosed embodiment shows the sensor bracket 100 attached to a portion of a drain pan, this is by way of example only. In alternate embodiments, the sensor bracket 100 can be attached to any portion of the heating and cooling device that is in the proper location with respect to potential refrigerant leaks and offers an acceptable place for the sensor bracket 100 to be attached. Although the disclosure will repeatedly refer to the sensor bracket 100 being attached to the drain pan, this is for ease of disclosure and should not be interpreted as limiting the disclosure to that embodiment. The disclosure should apply to any embodiment in which the sensor bracket 100 is attached to any suitable portion of the heating and cooling device.

In various embodiments, the sensor bracket 100 can be made of metal, plastic, or any suitable material. If the sensor bracket 100 is metal, it could be formed in such a way that a single sheet of metal can be cut and bent to form the sensor bracket 100. If the sensor bracket 100 is plastic, it can be plastic molded into its desired form.

Figure 2:
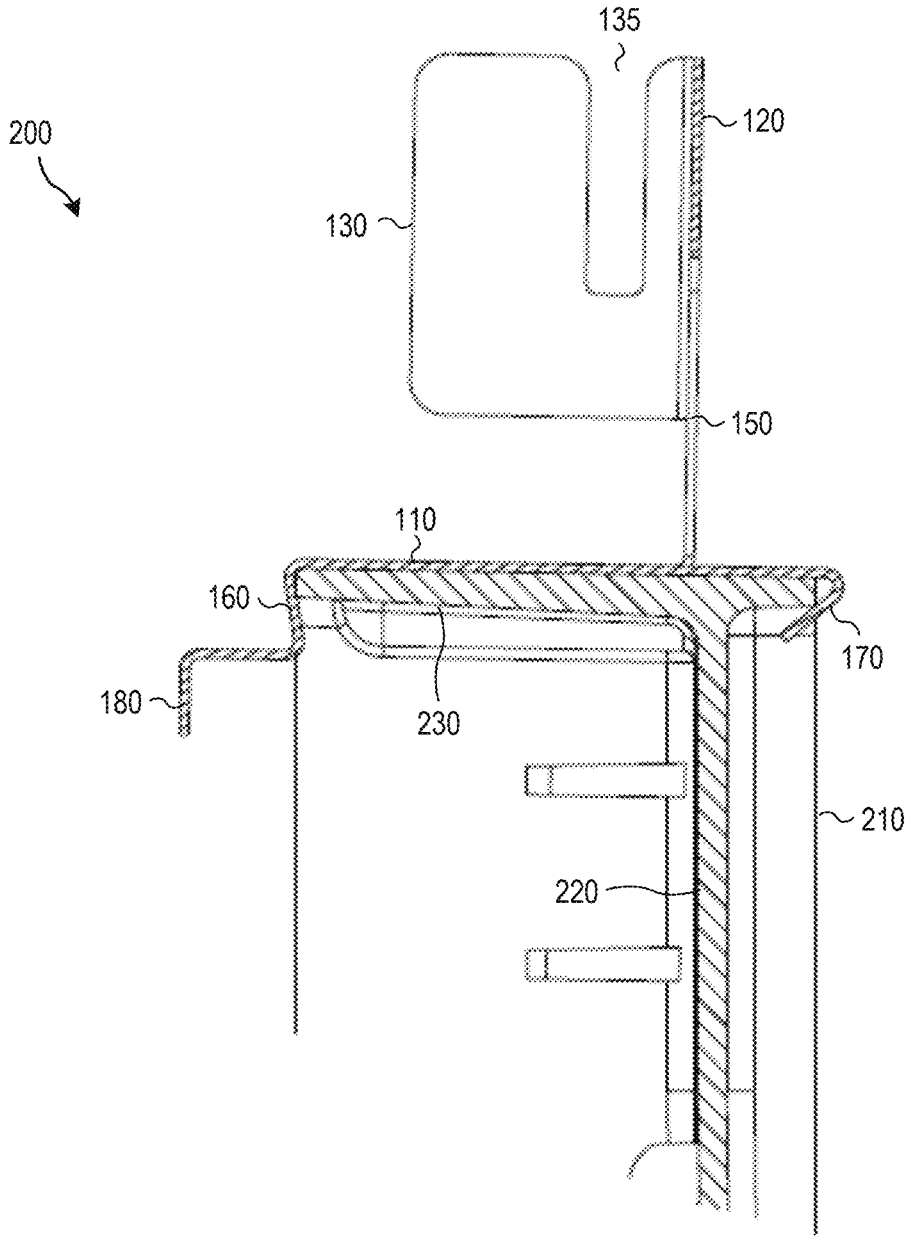
FIG. 2 is a side view of the sensor bracket of FIG. 1 attached to a heating and cooling device drain pan according to disclosed embodiments.

FIG. 2 is a side view 200 of the sensor bracket 100 of FIG. 1 attached to a heating and cooling device drain pan 210 according to disclosed embodiments. As shown in FIG. 2, the drain pan 210 includes a drain pan bottom 220 and a drain pan side wall 230.

In the embodiment of FIG. 2, the front fastener 160 is bent at an angle greater than 90° from the bottom panel 110 such that it points more towards the back of the sensor bracket 100 than towards the front of the sensor bracket 100. In this way, the front fastener 160 can hook around a portion of the drain pan side wall 230. Similarly, the back fastener 170 is bent at an angle greater than 90° from the bottom panel 110 such that it points more towards the front of the sensor bracket 100 than towards the back of the sensor bracket 100. In this way, the back fastener 170 can hook around a portion of the drain pan side wall 230 opposite the portion around which the front fastener 160 hooks. In this way, the front and back fasteners 160, 170 form a clip that clips around the side wall 230 of the drain pan 210.

As shown in FIG. 2, the fastening hold 180 extends in a direction different from the front fastener 160 and allows for a way for a user to deform the front fastener to widen the narrowest portion of the gap between the front fastener 160 and the back fastener 170 such that the sensor bracket 100 can be affixed to the drain pan side wall 230.

In an attaching operation, the back fastener 170 can be initially hooked around a first side of the drain pan side wall 230. The user can then apply pressure to the fastening hold 180 in either an upward direction or a frontward direction to deform the front fastener 160 such that the distance between the front fastener 160 and the back fastener 170 increases such that the front fastener 160 can be moved around a second side of the drain pan side wall 230 opposite the first side. Once the pressure on the fastening hold 180 is ended, the front fastener 160 returns to its original position, clamping the drain pan side wall 230 between the front and back fasteners 160, 170. An opposite operation will allow the sensor bracket 100 to be removed from the drain pan side wall.

In this way, the sensor bracket 100 is secured to the drain pan side wall 230 without the need for additional hardware to hold it in place.

Although the fastening hold 180 is shown as including two portions at approximately right angles to each other, this is by way of example. Alternate embodiment can vary the precise configuration of the fastening hold 180. For example, in some embodiments the fastening hold 180 can include only a single protrusion from the front fastener 160, roughly parallel to the bottom panel 110. Other embodiments can include a hole or a hook in the fastening hold 180 to allow a finger or a tool greater purchase in applying pressure to the fastening hold 180.

Although FIG. 2 shows an embodiment in which the sensor bracket 100 is secured to a drain pan side wall 230, this is by way of example only. Alternate embodiments could have the sensor bracket 100 be attached to any portion of a heating and cooling device around which the front and back fasteners 160, 170 can be secured.

Sensor Secured in Sensor Bracket

Figure 3:
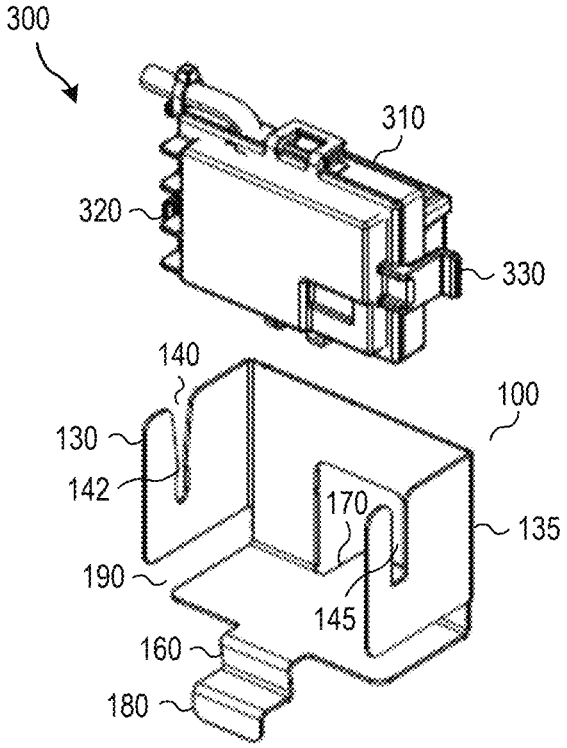
FIG. 3 is a perspective view of the sensor bracket of FIG. 1 and a refrigerant sensor in an unassembled configuration according to disclosed embodiments.

FIG. 3 is a perspective view 300 of the sensor bracket 100 of FIG. 1 and a refrigerant sensor 310 in an unassembled configuration according to disclosed embodiments. As shown in FIG. 3, a refrigerant sensor 310 is provided that includes a first protrusion 320 extending from one side and a second protrusion 330 extending from an opposite side.

The refrigerant sensor 310 is a circuit configured to detect the presence of refrigerant in air proximate to the refrigerant sensor 310. It can be configured to identify a quantifiable level of refrigerant in the nearby air, or it can be configured to identify when the level of refrigerant in the nearby air rises above the threshold refrigerant level in various embodiments. In some embodiments the refrigerant sensor 310 will be configured to detect a minimum threshold of refrigerant that will activate safety features and a response such as sounding an alarm or turning on a fan to circulate and dilute leaked refrigerant in the air in or proximate to the air conditioner. In an embodiment in which the refrigerant is an A2L refrigerant, the refrigerant sensor 310 is an A2L refrigerant sensor.

Although not show, the refrigerant sensor 310 will also have some sort of communication capability with the air conditioner controller (e.g., a wired connection or a wireless connection) to allow it to communicate the refrigerant level to a controller in the heating and cooling device.

The refrigerant sensor 310 is no larger than the sensor area 190, allowing it to fit into the sensor area 190.

The positions of the first and second protrusions 320, 330 are arranged to correspond to the positions of the first and second openings 140, 145 in the first and second side panels 130, 135 such that when the refrigerant sensor 310 is placed into the sensor area 190, the first and second protrusions 320, 330 will slide into the first and second openings, respectively.

As shown in FIG. 3, the second protrusion 330 includes a first portion extending directly out of the refrigerant sensor 310 and a second portion bent approximately perpendicular to the first portion. In this way, the refrigerant sensor 310, the first portion of the second protrusion 330, and the second portion of the second protrusion 330 form a U-shape that surrounds a part of the second side panel 135 and serves to better keep the refrigerant sensor 310 in position. Although not visible in FIG. 3, the first protrusion 320 will have a similar configuration and arrangement with respect to the first side panel 130.

The width of a first portion of the first protrusion 320 will be wider than a gap defined by the first narrow point 142 of the first opening 140 in the first side panel 130. In this way, the first protrusion cannot easily pass the first narrow portion 142 when it is being inserted into the first opening 140 or being removed from the first opening 140 without pressure being applied to the refrigerant sensor 310 sufficient to temporarily deform the first side panel 130 to temporarily widen the first narrow point 142.

Figure 4:
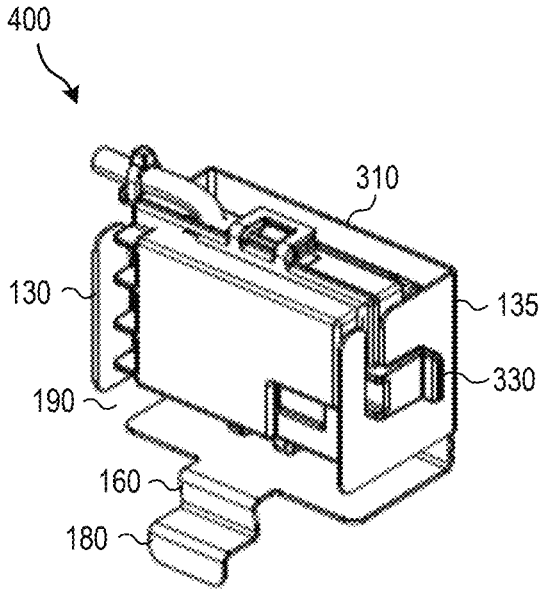
FIG. 4 is a perspective view of the sensor bracket of FIG. 1 and a refrigerant sensor in an assembled configuration according to disclosed embodiments.

FIG. 4 is a perspective view 400 of the sensor bracket 100 of FIG. 1 and a refrigerant sensor 310 in an assembled configuration according to disclosed embodiments.

As shown in FIG. 4, once the refrigerant sensor 310 is placed into the sensor area 190, the first and second protrusions 320, 330 are positioned in the first and second openings 140, 145, respectively. In this position, the refrigerant sensor 310 cannot easily move from its position. Interference between the refrigerant sensor 310 and the first and second side panels 130, 135 prevent the refrigerant sensor 310 from moving in either sideways direction. Interference between the first and second protrusions 320, 330 and the first and second side panels 130, 135, respectively, prevent the refrigerant sensor 310 from moving in a forward direction, a rearward direction, or a downward direction. Interference between the first projection 320 and the portions of the first side panel 130 that form the first narrow point 142 prevent the refrigerant sensor 310 from moving in an upward direction.

In this way, the refrigerant sensor 310 is secured in the sensor bracket 100 without the need for additional hardware to hold it in place.

Sensor Bracket Assembly

Figure 5A:
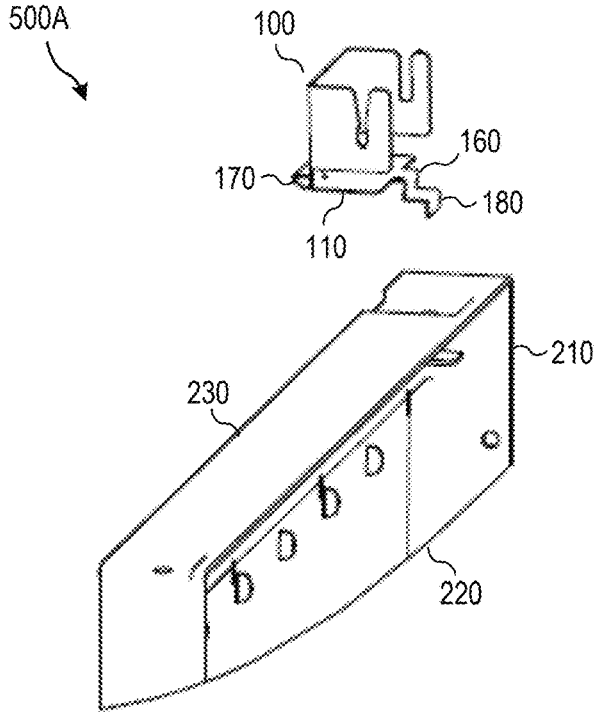
FIG. 5A is a perspective view of a sensor bracket assembly in an unattached configuration according to disclosed embodiments.
Figure 5B:
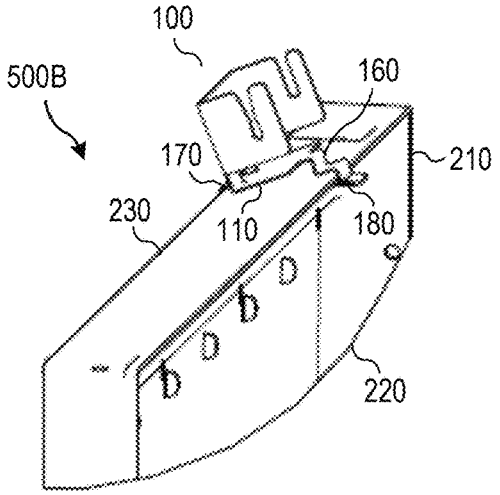
FIG. 5B is a perspective view of a sensor bracket assembly in an attaching configuration according to disclosed embodiments.
Figure 5C:
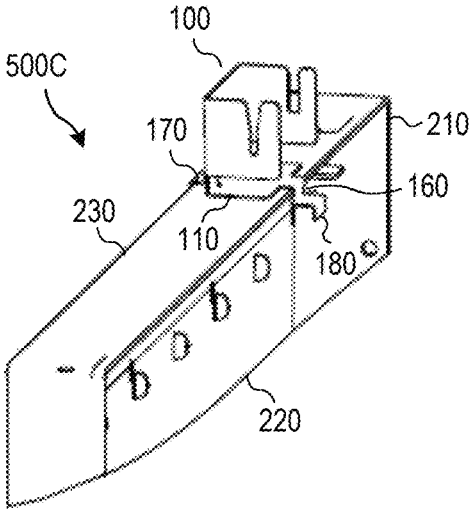
FIG. 5C is a perspective view of a sensor bracket assembly in an attached configuration according to disclosed embodiments.

FIGS. 5A-5C show how the sensor bracket 100 is attached to a drain pan side wall 230 to form a sensor bracket assembly 500A-500C. FIG. 5A is a perspective view of a sensor bracket assembly 500A in an unattached configuration according to disclosed embodiments; FIG. 5B is a perspective view of a sensor bracket assembly 500B in an attaching configuration according to disclosed embodiments; and FIG. 5C is a perspective view of a sensor bracket assembly 500C in an attached configuration according to disclosed embodiments.

Although FIGS. 5A-5C show the sensor bracket 100 being attached in an empty configuration, it could also be attached in a full configuration in which a refrigerant sensor is already secured into a sensor area 190.

As shown in FIG. 5A, the sensor bracket 100 is initially separate from the drain pan side wall 230. The sensor bracket 100 can be moved such that it is proximate to the drain pan wall 230.

As shown in FIG. 5B, the sensor bracket 100 is then positioned such that the back fastener 170 is hooked around one side of the drain pan side wall 230. In this position, the front fastener 160 will not be able to move around the opposite side of the drain pan side wall 230 from which the back fastener 170 is hooked because the narrowest width of the gap between the front and back fasteners 160, 170 is smaller than the length of the drain pan side wall 230.

However, as the front fastener 160 is moved towards the opposite side of the drain pan side wall 230 from which the back fastener 170 is hooked, the user can apply pressure to the fastening hold 180 to temporarily deform the front fastener 160 such that a narrowest width of the gap between the front and back fasteners 160, 170 temporarily widens sufficiently for the front fastener 160 to move around the opposite side of the drain pan side wall 230 from which the back fastener 170 is hooked.

As shown in FIG. 5C, once the sensor bracket 100 is in its final position, the user ceases applying pressure to the fastening hold 180 causing the front fastener 160 to return to its original position. At this point, the narrowest portion of the gap between the front and back fasteners 160, 170 is narrower than the length of the drain pan side wall 230. Since the drain pan side wall 230 is now positioned between this narrow point and the bottom panel 110, the sensor bracket 100 is securely affixed to the drain pan wall 230 and cannot easily be detached without pressure again being applied to the fastening hold 180. In this configuration, the front and back fasteners 160, 170 form a clip that attaches to the drain pan side wall 230 and holds the sensor bracket 100 in place with respect to the drain pan side wall 230.

The sensor bracket 100 can be detached from the drain pan side wall 230 by performing these operations in an opposite order.

As noted above, although this embodiment discloses the sensor bracket 100 being attached to a drain pan side wall 230, this is by way of example only. Alternate embodiments can secure the sensor bracket 100 to any suitable portion of a heating and cooling device.

Heating and Cooling Device with Sensor Bracket Assembly

Figure 6:
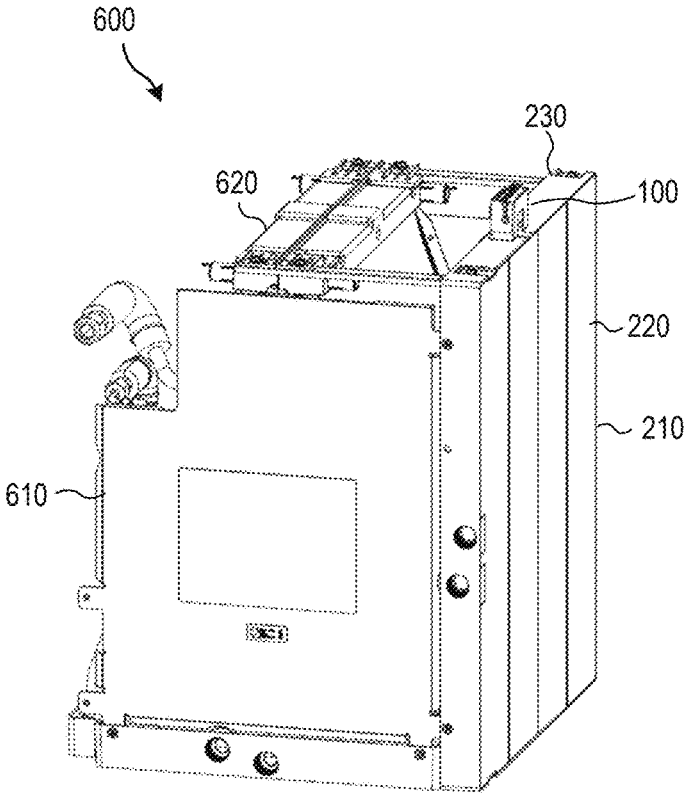
FIG. 6 is a perspective view of a sensor bracket assembly attached to a heating and cooling device according to disclosed embodiments.

FIG. 6 is a perspective view 600 of a sensor bracket assembly attached to a heating and cooling device 610 according to disclosed embodiments.

As shown in FIG. 6, a sensor bracket 100 is attached to a side wall 230 of a drain pan 210 in the heating and cooling device 610, adjacent to a heat exchanger 620 in the heating and cooling device 610. In this embodiment, the location where the sensor bracket 100 is secured is close to where brazing has been performed on refrigerant coils in the heat exchanger 620. This location is where refrigerant leaks are most likely to occur and so is a good location to position a refrigerant sensor to allow it to detect refrigerant leaks as quickly as possible.

Although the heating and cooling device 610 includes two drain pans, allowing the heating and cooling device to be arranged horizontally or vertically, the sensor bracket 100 in this embodiment is attached to the drain pan 210 with a drain pan wall 230 adjacent to the location in the heat exchanger 620 where refrigerant leaks are most likely.

Alternate Embodiments

Figure 7:
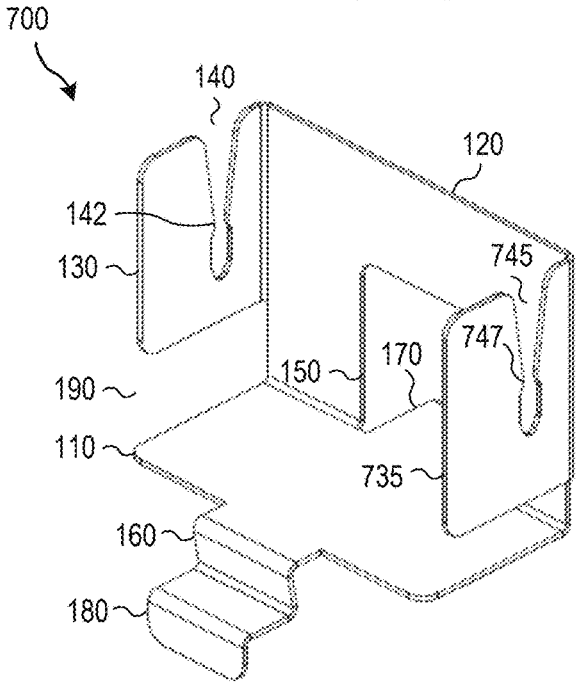
FIG. 7 is a perspective view of a sensor bracket according to alternate embodiments.

FIG. 7 is a perspective view of a sensor bracket 700 according to alternate embodiments. The embodiment of FIG. 7 is similar to the embodiment of FIG. 1, except that a second opening 745 in a second side panel 735 has a second narrow point 747 similar to the first narrow point 142 in the first opening 140. The following discussion will omit descriptions of portions of this embodiment at directly correspond to those of the embodiment of FIG. 1 for ease of disclosure.

As shown in FIG. 7, the sensor bracket 700 differs from the sensor bracket 100 in FIG. 1 in that the second side panel 135 of FIG. 1 is replaced with a second side panel 735 in which a second opening 745 is provided that includes a second narrow point 747. The second opening 745 and the second narrow point 747 correspond to the first opening 140 and the first narrow point 145 and serve the same purpose.

When a refrigerant sensor (not shown in FIG. 7) is inserted into the sensor area 190, protrusions (not shown in FIG. 7) on either side of the refrigerant sensor will slide into the first and second openings 140, 740.

The first narrow point 142 will be narrower than the width of a first protrusion from a corresponding first side of the refrigerant sensor, such that it will restrict the motion of the first protrusion past the first narrow point 142. Similarly, the second narrow point 747 will be narrower than the width of a second protrusion from a corresponding second side of the refrigerant sensor, such that it will restrict the motion of the second protrusion past the second narrow point 747. However, the material that constitutes the first and second side panels 130, 735 should be made of a material with sufficient flexibility that the first and second narrow points 142, 747 will widen when sufficient pressure is provided to press their sides apart but will then return to their original position once the pressure is removed.

In this way, the first and second protrusion can be pushed past the first and second narrow points 142, 747, respectively, when the refrigerant sensor is moved into the sensor area 190, but the first and second protrusions will not easily move back out of the first and second openings 140, 745 without a similar amount of pressure being applied to the refrigerant sensor to push the first and second protrusions again past the first and second narrow points 142, 747, respectively. This will allow the refrigerant sensor to be inserted into the sensor area 190 and removed from the sensor area 190 by applying sufficient force to the refrigerant sensor, but will allow that absent such force being applied, the refrigerant sensor will be secured into the sensor area 190 because the first and second protrusions cannot easily move past the first and second narrow points 142, 747, respectively.

Although restricting the movement of the first protrusion past the first narrow point 142 should be sufficient to prevent movement of the refrigerant sensor in an upward direction once the refrigerant sensor is secured in the sensor area 190, having two narrow points 142, 747 to restrict both the first and second protrusions will provide additional security of position.

CONCLUSION

This disclosure is intended to explain how to fashion and use various embodiments in accordance with the invention rather than to limit the true, intended, and fair scope and spirit thereof. The foregoing description is not intended to be exhaustive or to limit the invention to the precise form disclosed. Modifications or variations are possible in light of the above teachings. The embodiment(s) was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled. The various circuits described above can be implemented in discrete circuits or integrated circuits, as desired by implementation.

The invention claimed is:

1. A mounting bracket for a refrigerant sensor, comprising:

a back panel;

a first side panel attached to a first side of the back panel and having a first cut-out portion;

a second side panel attached to a second side of the back panel and having a second cut-out portion;

a fastening bracket formed adjacent to the back panel, the first side panel, and the second side panel; and a fastening hold attached to the fastening bracket and configured to allow a user to manually assist with fastening and unfastening the fastening bracket, wherein the first cut-out portion faces a top of the mounting bracket, the second cut-out portion faces the top of the mounting bracket, the first cut-out portion includes a first narrow point partway along its length such that a first part of the first cut-out portion closer to the top of the mounting bracket as compared to the first narrow point and a second part of the first cut-out portion farther from the top of the mounting bracket from the first narrow point both are wider than a width of the first narrow point, and the fastening bracket is configured to selectively affix to a portion of a heating and cooling device.

2. The mounting bracket of claim 1, further comprising
a bottom panel formed adjacent to the back panel, the first side panel, and the second side panel, the bottom panel being attached to the fastening bracket.

3. The mounting bracket of claim 1, wherein the fastening bracket includes
a first bent arm; and
a second bent arm,
the first and second bent arms being configured to grip the portion of the heating and cooling device.

4. The mounting bracket of claim 3, wherein
the fastening hold is a protrusion extending from the first bent arm configured to allow a user to push a clip open.

5. The mounting bracket of claim 1, further comprising
a bottom panel formed adjacent to the back panel, the first side panel, and the second side panel, the bottom panel being attached to the fastening bracket,
wherein
the fastening bracket includes
a first bent arm extending from a first side of the bottom panel; and
a second bent arm extending from a second side of the bottom panel opposite the first panel, and
the first and second bent arms being configured to grip a portion of a heating and cooling device.

6. The mounting bracket of claim 1, wherein
the first side panel is made of a material of sufficient elasticity to allow the first narrow point to temporarily widen when pressure is applied to sides of the first cut-out portion.

7. The mounting bracket of claim 1, wherein
the second cut-out portion includes a second narrow point partway along its length such that a first part of the second cut-out portion closer to the top of the mounting bracket as compared to the second narrow point and a second part of the second cut-out portion farther from the top of the mounting bracket from the second narrow point both are wider than a width of the second narrow point.

8. The mounting bracket of claim 7, wherein
the second side panel is made of a material of sufficient elasticity to allow the second narrow point to temporarily widen when pressure is applied to sides of the second cut-out portion.

9. A sensor mounting assembly, comprising:
a mounting bracket, including
a back panel;
a first side panel attached to a first side of the back panel and having a first cut-out portion;
a second side panel attached to a second side of the back panel and having a second cut-out portion;
a fastening bracket formed adjacent to the back panel, the first side panel, and the second side panel; and
a fastening hold attached to the fastening bracket and configured to allow a user to manually assist with fastening and unfastening the fastening bracket; and
a refrigerant sensor assembly, including
a refrigerant sensor circuit configured to detect refrigerant in air proximate to the refrigerant sensor;
a first protrusion extending from a first side of the refrigerant sensor circuit; and
a second protrusion extending from a second side of the refrigerant sensor circuit, wherein
the first cut-out portion faces a top of the mounting bracket,
the second cut-out portion faces the top of the mounting bracket,
the first cut-out portion includes a first narrow point partway along its length such that a first part of the first cut-out portion closer to the top of the mounting bracket as compared to the first narrow point and a second part of the first cut-out portion farther from the top of the mounting bracket from the first narrow point both are wider than a width of the first narrow point,
the fastening bracket is configured to selectively affix to a portion of a heating and cooling device,
the refrigerant sensor assembly is formed inside a cavity formed by the back panel, the first side panel, and the second side panel,
the first protrusion extends into the first cut-out portion,
the second protrusion extends into the second cut-out portion, and
the first narrow point restrains the refrigerant sensor assembly from moving out of the cavity.

10. The sensor mounting assembly of claim 9, further comprising
a bottom panel formed adjacent to the back panel, the first side panel, and the second side panel, the bottom panel being attached to the fastening bracket, and
the back panel, the first side panel, the second side panel, and the bottom panel defining the cavity.

11. The sensor mounting assembly of claim 9, wherein the fastening bracket includes
a first bent arm; and
a second bent arm,
the first and second bent arms being configured to grip the portion of the heating and cooling device.

12. The sensor mounting assembly of claim 11, wherein
the fastening hold is a protrusion extending from the first bent arm configured to allow a user to push a clip open.

13. The sensor mounting assembly of claim 9, further comprising
a bottom panel formed adjacent to the back panel, the first side panel, and the second side panel, the bottom panel being attached to the fastening bracket,
wherein
the fastening hold includes
a first bent arm extending from a first side of the bottom panel; and
a second bent arm extending from a second side of the bottom panel opposite the first panel, and
the first and second bent arms being configured to grip a portion of a heating and cooling device.

14. The sensor mounting assembly of claim 9, wherein
the first side panel is made of a material of sufficient elasticity to allow the first narrow point to temporarily widen when pressure is applied to sides of the first cut-out portion.

15. The sensor mounting assembly of claim 9, wherein
the second cut-out portion includes a second narrow point partway along its length such that a first part of the second cut-out portion closer to the top of the mounting bracket as compared to the second narrow point and a second part of the second cut-out portion farther from the top of the mounting bracket from the second narrow point both are wider than a width of the second narrow point.

16. The sensor mounting assembly of claim 15, wherein
the second side panel is made of a material of sufficient elasticity to allow the second narrow point to temporarily widen when pressure is applied to sides of the second cut-out portion.

* * * * *